United States Patent [19]

Morrow

[11] Patent Number: 4,972,863

[45] Date of Patent: Nov. 27, 1990

[54] RAIN GUTTER CLEANER

[75] Inventor: Carl R. Morrow, Longview, Wash.

[73] Assignee: Dan Golden, Walla Walla, Wash.

[21] Appl. No.: 382,231

[22] Filed: Jul. 19, 1989

[51] Int. Cl.[5] ..... B08B 3/02

[52] U.S. Cl. ..... 134/166 R; 134/167 R; 134/198; 52/11

[58] Field of Search ..... 134/166 R, 167 R, 166 C, 134/167 C, 198; 52/11, 16

[56] References Cited

U.S. PATENT DOCUMENTS

| | | | |
|---|---|---|---|
| 2,710,616 | 6/1955 | Tydings | 134/167 R |
| 3,041,655 | 7/1962 | Entler | 134/167 R X |
| 4,117,635 | 10/1978 | Nelson | 52/11 |
| 4,183,368 | 1/1980 | Husted | 134/166 R |
| 4,447,927 | 5/1984 | Malless, Jr. | 15/145 X |
| 4,602,460 | 6/1986 | Langenbach | 52/1 |
| 4,634,312 | 1/1987 | Sterzel | 134/166 C |

*Primary Examiner*—Frankie L. Stinson

*Attorney, Agent, or Firm*—Wells, St. John & Roberts

[57] ABSTRACT

A rain gutter cleaner is disclosed for cleaning accumulated debris from a rain gutter. The cleaner includes an attachment to secure the device to a source of fluid under pressure such as garden hose. The device includes discharge orifices that direct streams of the fluid along the length of the gutter to clean debris from the gutter surfaces. The device may be supplied as an attachment for existing gutters, or may be incorporated with the gutter itself.

7 Claims, 1 Drawing Sheet

RAIN GUTTER CLEANER

TECHNICAL FIELD

The present invention relates to apparatus for in situ cleaning of rain gutters.

BACKGROUND OF THE INVENTION

Rain gutters are notorious for accumulating dirt and debris over relatively short periods of time. It becomes desirable to periodically clean the gutters of the accumulation to insure that they will function correctly. This has been done typically by climbing a step ladder and using a trowel, brush, etc., to dislodge the debris. A garden hose may also be used to wash the dislodged debris along the gutter and down the down spout. The cleaning process is hazardous due to the precarious position often assumed by the cleaner on a step ladder.

The above problem has been realized to a limited degree by U.S. Pat. Nos. 4,602,460 to Langenbach and 4,117,635 to Nelson. The Langenbach patent was issued in 1968 for a water-powered gutter and down spout cleaning and apparatus. This device makes use of a water-powered motor connected to a household water supply for driving a auger situated within the gutter down spout. The device is intended to auger accumulated materials down and outwardly of the down spout. The Nelson patent was issued in 1978 for an "easy clean eave trough". This device makes use of an apparatus for selectively tipping the eave trough or rain gutter to an inverted orientation in order to dump the contents and to present the trough in a downwardly open orientation for cleaning or maintenance purposes.

While the above apparatus appear functional, they are relatively complex, expensive and difficult to install and maintain.

The present invention facilitates cleaning of rain gutters by streams of pressurized fluid such as water that are directed along the length of the rain gutter to wash away accumulated debris. The device is very simple in construction and is intended to be easily connected to a fluid conduit such as a common garden hose. The present device can be installed on existing rain gutters, or may be supplied with new gutter construction.

BRIEF DESCRIPTION OF THE DRAWINGS

Preferred embodiments of the invention are illustrated in the accompanying drawings, in which.

DETAILED DESCRIPTION OF THE PREFERRED EMBODIMENTS

Figures 1, 2, 3, 4:
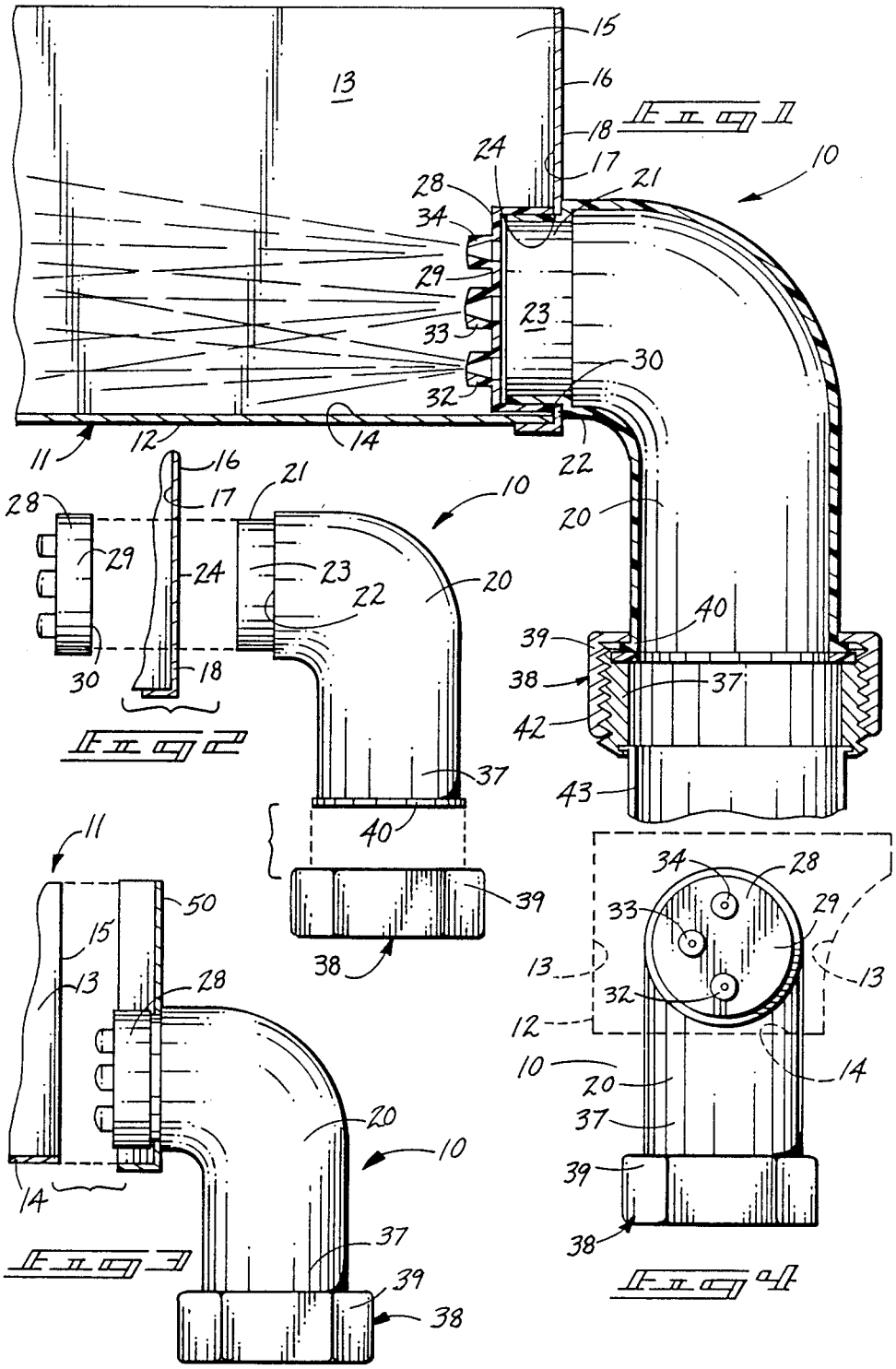
FIG. 1 is a sectional view of a first preferred form of the present rain gutter cleaner as an attachment to a rain gutter.
FIG. 2 is a exploded view of the preferred form.
FIG. 3 is a view of an alternate form of the present rain gutter cleaner in combination with the end cap of a rain gutter.
FIG. 4 is an end view of an assembled cleaner showing orientation of nozzles thereon.

The following disclosure of the invention is submitted in compliance with the constitutional purpose of the Patent Laws "to promote the progress of science and useful arts" (Article 1, Section 8).

Exemplary forms of the present invention are illustrated in the drawings. In a first preferred embodiment, the present rain gutter cleaner is shown at 10 as an attachment to an existing form of rain gutter 11 at an end cap 16. The cleaner 10 is alternatively shown in FIG. 3 including an integrated rain gutter end cap 50. In another variation, the cleaner is included as an integrated part of the entire rain gutter 11.

All forms of the present cleaner 10 are intended for utilization in cleaning the elongated trough 12 of a rain gutter 11 typically utilized to catch and direct drainage from roofs or similar structures to an open discharge end or to a conventional down spout (not shown).

The trough 12 is of conventional form, comprised of upright sidewalls 13 joined by a bottom wall 14. The trough will typically include an end 15 that is covered by an end cap 16. The end cap, for purposes of later description, includes an inner surface 17 and outwardly facing surface 18.

All forms of the present rain gutter cleaner 10 include a hollow body 20. The body 20 may be formed of a corrosion resistant material such as injection molded plastic. Body 20 extends from one end 21 having a discharge nozzle 28 mounted thereon.

In the preferred form the one end 21 also includes a shoulder 22. A reduced section 23 projects outwardly from the shoulder 22. The reduced section 23 receives the nozzle 28.

In a preferred form, the nozzle 28 includes a cap section 29 that slidably or threadably fits over the reduced section 23 of the hollow body. The cap 29 includes a shoulder 30 facing opposite to the shoulder 22 of the hollow body.

Discharge orifices are supplied along the nozzle. The orifices are preferably arranged to direct streams of fluid along the length of the rain gutter when the cleaner is attached thereto. As shown, the orifices are preferably arranged substantially vertically. Alternatively they may be otherwise angularly oriented in order to vary the trajectories of the streams passing therethrough.

In the preferred form a short range orifice 32 is situated adjacent to the bottom wall of the gutter with a mid-range orifice 33 situated slightly above and a long-range orifice 34 situated above the mid range orifice 33. It has been found that this arrangement of orifices is preferred to provide jets of fluid such as water under normal household operating pressures, to clean rain gutters of substantial length.

The reduced section 23, shoulder 22, and cap shoulder 30 are exemplary of a preferred attachment means on the hollow body for mounting the body to a rain gutter with the discharge nozzle openings oriented to direct streams of fluid along the length of the rain gutter. The reduced section 23 is fitted through a hole or aperture 24 (FIG. 2) formed in the rain gutter end cap 16 between the surfaces 17, 18 thereof. The hole 24 may be formed by conventional cutting equipment, such as drills, shears, etc. The hole is preferably made to be of sufficient size to slidably receive the reduced section 23. The shoulder 22 will therefore come into abutment with the outer surface 18 of the end cap The shoulder 30 of the nozzle 28 may then be moved over the portion of the reduced section 23 projecting into the rain gutter. The shoulder 30 will thus move into abutment with the inner end cap surface 17. The shoulder surfaces will therefore sandwich the engaged surfaces of the end cap and secure the cleaner in position.

The above exemplifies a preferred means for attaching the cleaner to a rain gutter. FIG. 3 is illustrative of another form of attachment. Here, the cleaner is provided substantially integrally with an end cap 50 formed to be attached to an end 15 of a conventional rain gutter. The end cap 50 closely resembles the conventional end cap 16 configuration and will therefore facilitate assembly of the device with a conventional rain gutter using known assembly techniques. In this manner, the rain gutter cleaner 10 is attached to the rain gutter in the same manner utilized for installing a conventional end cap.

In another alternate example of the present invention, the hollow body is included as an integrated part of the entire rain gutter structure. This arrangement is indicated by dashed lines in FIG. 3 in which the end cap and the rain gutter are fully assembled with the cleaner in place.

The above arrangements exemplify various forms by which the present cleaner may be attached or provided integrally with an end cap or rain gutter. Other forms of attachment or integration of the cleaner with a rain gutter or gutter end cap may also be derived from the teachings of this disclosure.

In all forms of the present cleaner, the hollow body 20 extends to a remaining end 37 (opposite the one end 21). The remaining end 37 includes a fitting 38 adapted to be mounted to a fluid conduit such as a garden hose 43 (FIG. 1).

The fitting 38 is preferably comprised of a nut 39 rotatably mounted to a flange 40 at the remaining end of the hollow body. The nut 39 preferably includes internal threads 42 for appropriate connection to the typical male end of a fluid conduit such as the garden hose 43.

Other forms of connection may also be envisioned. For example, the body could be substantially more elongated than presently shown with a fitting at a remote end for attachment directly to a fluid conduit such as the tap or spigot of a water line. The fitting could also be altered to accommodate various standard form fittings supplied at the discharge ends of conventional fluid conduits such as water hoses. Preferably, however, the present cleaner includes the relatively short hollow body shown and described herein. The preferred fitting 38 is provided for attachment to a conventional conduit such as a garden hose to facilitate periodic attachment and detachment of a garden hose 43 to and from the cleaner 10. The hose 43 is thus free for other use when the cleaner is not being used and the cleaner size is minimized to avoid changing the visual appearance of the adjacent structure. The shortened hollow body is also preferred due to minimal expense in manufacture, storage and shipping.

Assembly of the first preferred form of the present cleaner is accomplished first by cutting or otherwise forming a hole 24 in the conventional rain gutter end cap 16. The hole is formed to be complementary to, but slightly larger in size than the cross sectional dimension of the reduced section 23 of the hollow body 20. Following formation of the hole, the gutter cleaner may be assembled with the end cap 16 by inserting the reduced section 23 through the formed hole 24. This brings the one end 21 through the end cap and exposes a section of the reduced section 23 for receiving the nozzle 28. As indicated above, the nozzle may be attached to the section 23 by adhesive, or by appropriate threading arrangements (not shown). Care is taken at this point to locate the discharge orifices in a desired orientation so the trajectories of the resulting streams through the orifices will produce short, mid, and long-range spray streams. A vertical arrangement substantially as illustrated in FIG. 4 is preferred to this purpose.

The assembled rain gutter cleaner and end cap may now be assembled with the rain gutter in the usual manner by which conventional end caps are attached to conventional rain gutters.

Assembly of the integrated version shown in FIG. 3. is accomplished simply by securing the integral cap 50 in the conventional manner over the exposed end of a rain gutter This procedure automatically positions the gutter cleaner in proper relation to the sides and bottom of the gutter for subsequent operation.

Versions in which the gutter cleaner is an integrated part of the rain gutter system is installed as the gutter is installed.

Once the rain gutter is installed and operational, the cleaner is also in position and is ready for operation.

To operate the present gutter cleaner, the hollow body is attached to a source of fluid under pressure such as an outdoor water spigot. Attachment may be made simply through use of a garden hose 43 extending between the spigot and the fitting 38.

Operation is initiated simply by supplying the fluid under pressure to the device, as by opening an associated water spigot. The water under pressure will then be discharged through the discharge orifices. The streams of water will act against the surfaces of the rain gutter to clean the surfaces of accumulated materials. Force of the streams will cause the materials to move toward opposite end of the gutter where, typically, a down spout or discharge is provided.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims appropriately interpreted in accordance with the doctrine of equivalents.

What is claimed is:

1. A rain gutter cleaner, comprising:

a hollow body having a discharge nozzle with at least one discharge opening at one end;

a fitting at a remaining end of the hollow body adapted to mount a fluid conduit such as a garden hose; and a rain gutter end cap mounted to the hollow body to be fitted over an open end of an elongated rain gutter, to close the open end of the rain gutter and orient the discharge opening longitudinally with respect to the rain gutter to direct a stream of fluid longitudinally along the rain gutter.

2. The rain gutter cleaner of claim 1 wherein the discharge nozzle is removably mountable to the one end of the hollow body.

3. The rain gutter cleaner of claim 2 further comprising a shoulder on the discharge nozzle adapted to engage the end cap along an inward surface thereof, and a shoulder on the hollow body adapted to engage the end cap along an outward surface thereof.

4. The rain gutter cleaner of claim 1 wherein the nozzle includes three discharge openings oriented in relation to one another to produce short range, medium range, and long range spray trajectories.

5. The rain gutter cleaner of claim 1 wherein the fitting is comprised of a rotatable nut on the housing having threads adapted to threadably engage mating threads of a garden hose.

6. A rain gutter cleaner for attachment to a rain gutter including an elongated trough and an end cap across an end thereof having an aperture formed therein, from an inward cap surface to an outward cap surface, the gutter cleaner comprising:

a hollow body extending between one end and a remaining end;

a nozzle having a discharge orifice mountable to the one end of the hollow body adapted to engage the end cap along the inward cap surface;

the one end of the hollow body including a shoulder adapted to engage the end cap along the outward cap surface;

wherein the nozzle and the one end of the hollow body are adapted to be joined together through the end cap aperture so the end cap is secured between the nozzle and the shoulder of the hollow body; and a fitting at the remaining end of the hollow body adapted for connection to a fluid conduit such as a garden hose.

7. In a rain gutter, an elongated trough having side walls joined by a bottom wall;

an end cap spanning the trough and closing an end thereof;

a nozzle means on the end cap with a discharge orifice for directing a stream of fluid under pressure along the trough; and a fitting operatively connected to the nozzle means for connection to a source of fluid under pressure.

* * * * *